US009852695B2

(12) United States Patent
Choi

(10) Patent No.: US 9,852,695 B2
(45) Date of Patent: Dec. 26, 2017

(54) ORGANIC LIGHT EMITTING DIODE DISPLAY CAPABLE OF EXTENDING SENSING TIME AND REDUCING AN UPDATE CYCLE

(71) Applicant: LG DISPLAY CO., LTD., Seoul (KR)

(72) Inventor: Kyoungsik Choi, Daejeon (KR)

(73) Assignee: LG DISPLAY CO., LTD., Seoul (KR)

( * ) Notice: Subject to any disclaimer, the term of this patent is extended or adjusted under 35 U.S.C. 154(b) by 73 days.

(21) Appl. No.: 14/552,869

(22) Filed: Nov. 25, 2014

(65) Prior Publication Data

US 2015/0170578 A1 Jun. 18, 2015

(30) Foreign Application Priority Data

Dec. 16, 2013 (KR) ..... 10-2013-0156370

(51) Int. Cl.
*G09G 3/36* (2006.01)
*G09G 3/3266* (2016.01)

(52) U.S. Cl.
CPC ... *G09G 3/3266* (2013.01); *G09G 2310/0262* (2013.01); *G09G 2320/0233* (2013.01); *G09G 2340/0435* (2013.01); *G09G 2360/18* (2013.01)

(58) Field of Classification Search
CPC ..... G09G 2320/043–2320/048; G09G 2320/0295; G09G 2300/0819; G09G 2310/061; G09G 3/30–3/3291; G09G 2340/0435; G06F 3/0412
See application file for complete search history.

(56) References Cited

U.S. PATENT DOCUMENTS 6,489,964 B1 * 12/2002 Van Asma ..... G09G 5/393 345/545
2005/0140635 A1 * 6/2005 Kwon ..... G09G 3/3611 345/98
2005/0184933 A1 * 8/2005 Tomohara ..... G09G 3/3208 345/76
2008/0218499 A1 * 9/2008 Kohno ..... G09G 3/3233 345/204
2008/0238833 A1 * 10/2008 Hioki ..... G09G 3/3233 345/76

(Continued)

FOREIGN PATENT DOCUMENTS

CN 103050083 A 4/2013
CN 103123774 A 5/2013

(Continued)

*Primary Examiner* — Pegeman Karimi
(74) *Attorney, Agent, or Firm* — Dentons US LLP

(57) ABSTRACT

An organic light emitting diode display includes a data driving circuit which converts pixel data into a data voltage and supplies the data voltage to data lines during a data enable period, and senses changes in driving characteristics of a display panel within an extended vertical blank period, a scan driving circuit which supplies a scan pulse synchronized with the data voltage to scan lines during the data enable period, and outputs a scan pulse within the extended vertical blank period, and a timing controller which compensates for data of an input image using a compensation value determined based on the changes in the driving characteristics, transmits the compensated data to the data driving circuit, and controls operation timing of the data driving circuit and operation timing of the scan driving circuit.

5 Claims, 11 Drawing Sheets

(56) References Cited

U.S. PATENT DOCUMENTS

2008/0238834 A1* 10/2008 Matsuo ..... G09G 3/3233 345/76
2008/0252569 A1* 10/2008 Kwon ..... G09G 3/3233 345/76
2008/0252570 A1* 10/2008 Kwon ..... G09G 3/3233 345/76
2008/0303754 A1* 12/2008 Murata ..... G09G 3/3233 345/76
2009/0051628 A1* 2/2009 Kwon ..... G09G 3/3233 345/77
2009/0179832 A1* 7/2009 Kohno ..... G09G 3/3233 345/76
2009/0184896 A1* 7/2009 Kwon ..... G09G 3/3233 345/76
2009/0184903 A1* 7/2009 Kwon ..... G09G 3/3225 345/80
2011/0210939 A1* 9/2011 Reynolds ..... G06F 3/0418 345/174
2011/0227505 A1* 9/2011 Park ..... H05B 33/0896 315/297
2013/0038621 A1* 2/2013 Choi ..... G09G 3/2092 345/589
2013/0093652 A1* 4/2013 Kim ..... G09G 3/3233 345/77
2013/0127692 A1* 5/2013 Yoon ..... G09G 3/3258 345/80
2013/0162617 A1* 6/2013 Yoon ..... G09G 3/3291 345/211
2013/0194229 A1* 8/2013 Sabo ..... G06F 3/044 345/174

FOREIGN PATENT DOCUMENTS

CN 103177685 A 6/2013
GB 2498634 A 7/2013

* cited by examiner (A)

(B)

ORGANIC LIGHT EMITTING DIODE DISPLAY CAPABLE OF EXTENDING SENSING TIME AND REDUCING AN UPDATE CYCLE

This application claims the benefit of Korean Patent Application No. 10-2013-0156370 filed on Dec. 16, 2013, the entire contents of which is incorporated herein by reference for all purposes as if fully set forth herein.

BACKGROUND OF THE INVENTION

Field of the Invention

Embodiments of the invention relate to an organic light emitting diode display.

Discussion of the Related Art

An organic light emitting diode (OLED) display is a self-emission display device. The OLED display may be manufactured to have lower power consumption and a thinner profile than a liquid crystal display requiring a backlight unit. Further, the OLED display has advantages of a wide viewing angle and a fast response time. As the development of process technology reaches large-sized screen mass production technology, the OLED display has expanded its market while competing with the liquid crystal display.

Each pixel of the OLED display includes an organic light emitting diode (OLED) having a self-emitting structure. As shown in FIG. 1, organic compound layers including a hole injection layer HIL, a hole transport layer HTL, an emission layer EML, an electron transport layer ETL, an electron injection layer EIL, etc. are stacked between an anode and a cathode of the OLED. The OLED display implements an input image using a phenomenon, in which the OLED emits light when electrons and holes are combined in an organic layer through a current flowing in a fluorescence or phosphorescence organic thin film.

The OLED display may be variously classified depending on kinds of emission materials, an emission method, an emission structure, a driving method, etc. The OLED display may be classified into a fluorescent emission type and a phosphorescent emission type depending on the emission method. Further, the OLED display may be classified into a top emission type and a bottom emission type based upon the emission structure. Also, the OLED display may be classified into a passive matrix OLED (PMOLED) display and an active matrix OLED (AMOLED) display depending on the driving method.

Each pixel of the OLED display includes a driving thin film transistor (TFT) controlling a driving current flowing in the OLED depending on data of the input image. Characteristics, such as a threshold voltage and a mobility, of the driving TFT have to be equally designed in all of the pixels of the OLED display, but are not uniform depending on a process deviation, a driving time, a driving environment, etc. Thus, the OLED display has adopted a compensation technology for sensing changes in driving characteristics of the pixels to properly change input data based on the sensing result. The changes in the driving characteristic of the pixel include changes in the characteristic of the driving TFT including the threshold voltage, the mobility, etc. of the driving TFT.

The changes in the driving characteristic of the pixel may be estimated based on changes in a source voltage of the driving TFT. However, because it takes much time to sense the characteristic of the driving TFT, it is difficult to secure a sensing time during a normal drive.

Time capable of sensing the characteristic of the driving TFT during the normal drive of the OLED display may be assigned within a vertical blank period, in which new data is not applied to the pixel. The vertical blank period is a period, in which there is no data enable signal DE between an Nth frame period and an (N+1)th frame period, where N is a positive integer. The data enable signal DE is synchronized with data of the input image to be displayed on a display panel. The data of the input image is not input in the vertical blank period. However, because a length of the vertical blank period is short, only changes in driving characteristics of sub-pixels of one color arranged in one line can be sensed during one vertical blank period. As a result, because an update cycle of a compensation value of the sub-pixels of each color in all of the pixels lengthens, the changes in the driving characteristic cannot be rapidly compensated.

SUMMARY OF THE INVENTION

Embodiments of the invention provide an organic light emitting diode (OLED) display capable of extending a sensing time and reducing an update cycle of a compensation value, so that changes in driving characteristics of a plurality of pixels can be sensed within the sensing time assigned to sense changes in driving characteristics of the pixels.

In one aspect, there is an organic light emitting diode display, in which one frame period is divided into a data enable period and a vertical blank period, comprising a data driving circuit configured to convert pixel data into a data voltage and supply the data voltage to data lines of a display panel during the data enable period, and to sense changes in driving characteristics of the display panel within an extended vertical blank period, a scan driving circuit configured to supply a scan pulse synchronized with the data voltage to scan lines of the display panel during the data enable period, and to output a scan pulse for sensing the changes in the driving characteristics within the extended vertical blank period, and a timing controller configured to compensate for data of an input image using a compensation value determined based on the changes in the driving characteristics, transmit the compensated data to the data driving circuit, and control operation timing of the data driving circuit and operation timing of the scan driving circuit.

The timing controller shortens the data enable period defined by an input timing signal and controls the extended vertical blank period to be longer than the vertical blank period defined by the input timing signal.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Figure 2:
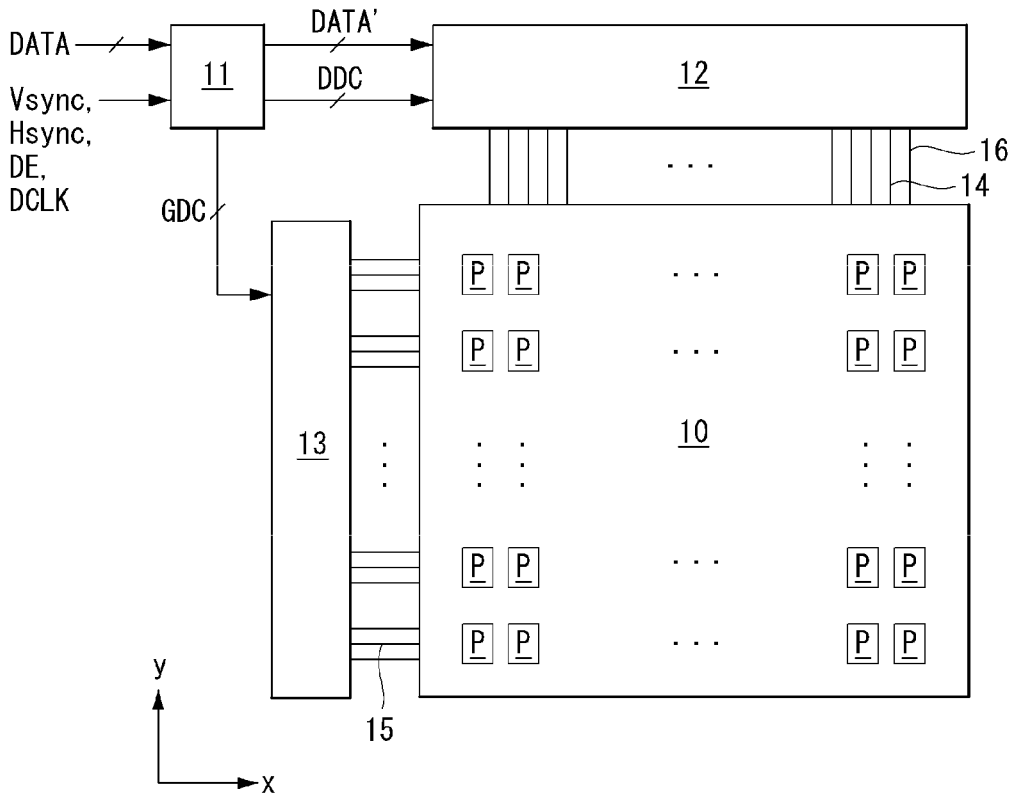
FIG. 2 is a block diagram of an organic light emitting diode (OLED) display according to an exemplary embodiment of the invention.
Figure 3:
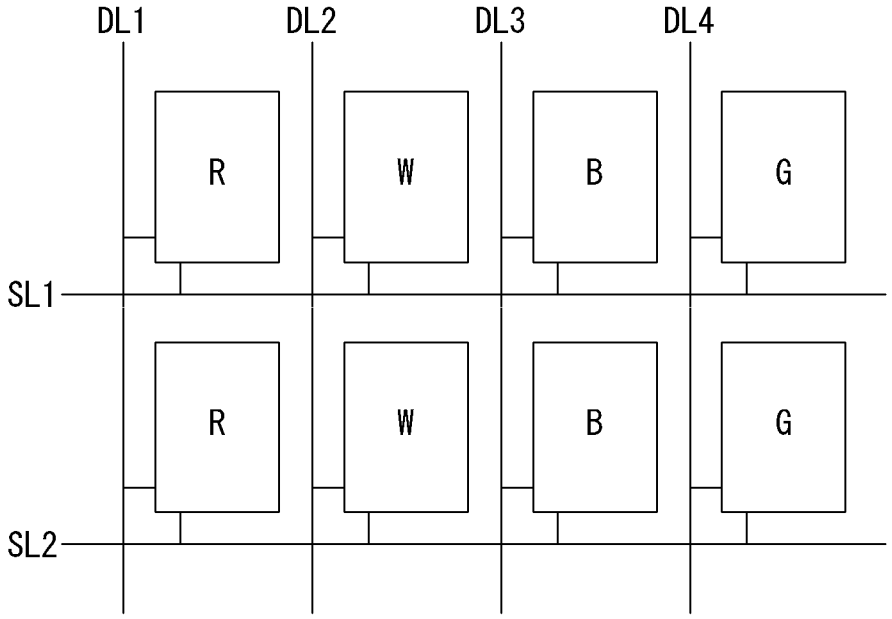
FIG. 3 shows sub-pixels.
Figure 4:
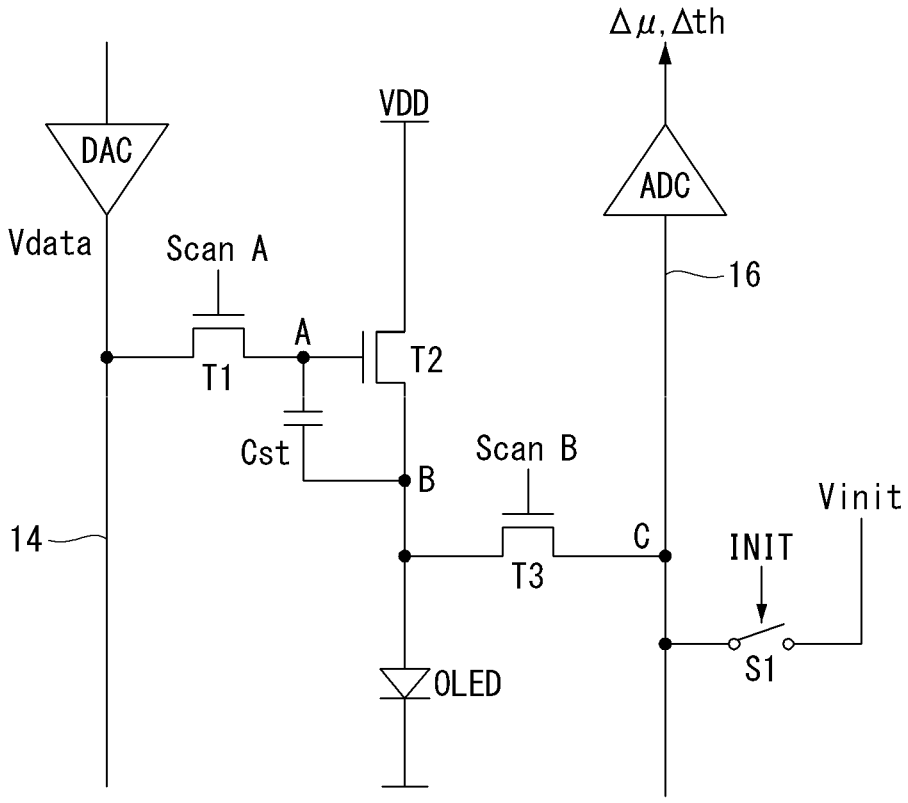
FIG. 4 is an equivalent circuit diagram of a pixel.

As shown in FIGS. 2 to 4, an organic light emitting diode (OLED) display according to an exemplary embodiment of the invention includes a display panel 10 and a display panel driving circuit.

Data of an input image is displayed on a pixel array of the display panel 10. The pixel array of the display panel 10 includes a plurality of data lines 14, a plurality of scan lines 15 crossing the data lines 14, and a plurality of pixels P arranged in a matrix form. Each pixel P may include a red sub-pixel R, a green sub-pixel G, and a blue sub-pixel B for the color representation. As shown in FIG. 3, each pixel P may further include a white sub-pixel W. Reference lines 16 for sensing a change amount of driving characteristics of the pixels are formed on the display panel 10. In FIG. 3, DL1 to DL4 denote the data lines 14, and SL1 and SL2 denote the scan lines 15. A pair of scan lines may be connected to each sub-pixel, so that first and second scan pulses Scan A and Scan B may be applied to each sub-pixel.

The change amount of the driving characteristic of the pixel includes changes in characteristic of a driving thin film transistor (TFT), such as a change amount $\Delta Vth$ of a threshold voltage of the driving TFT and a change amount $\Delta\mu$, of a mobility of the driving TFT. The changes in the driving characteristic of the pixel may be sensed based on changes in a source voltage of the driving TFT in the sub-pixels of each color.

Figure 1:
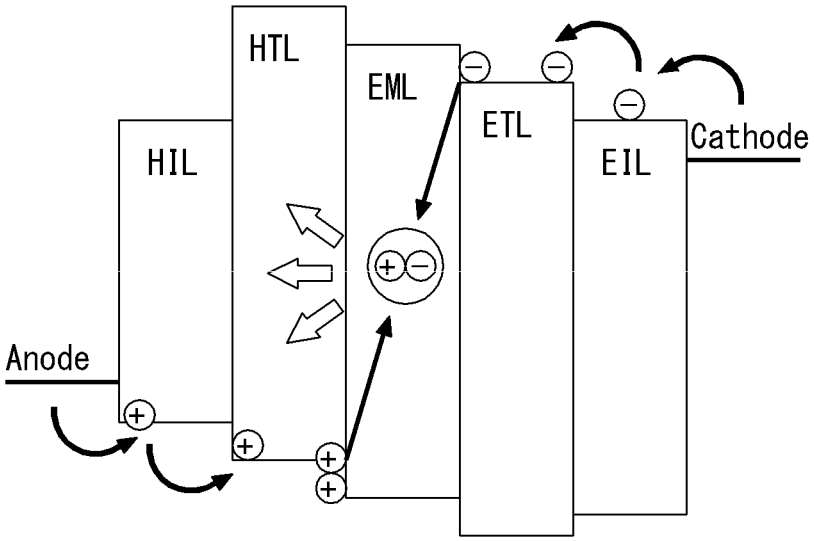
FIG. 1 (RELATED ART)
FIG. 1 shows a structure and an emission principle of an organic light emitting diode (OLED)

As shown in FIG. 4, each pixel P may include three TFTs T1, T2, and T3, a storage capacitor Cst, and an OLED, but is not limited thereto. As shown in FIG. 1, the OLED may be configured so that organic compound layers including a hole injection layer HIL, a hole transport layer HTL, an emission layer EML, an electron transport layer ETL, an electron injection layer EIL, etc. are stacked. The first TFT T1 applies a data voltage, which is input through the data line 14 in responses to the first scan pulse Scan A, to a gate of the second TFT T2 through a first node A. A gate of the first TFT T1 is connected to the first scan line 15, to which the first scan pulse Scan A is applied. A drain of the first TFT T1 is connected to the data line 14, and a source of the first TFT T1 is connected to the gate of the second TFT T2 via the first node A. The second TFT T2 is a driving TFT that adjusts a current flowing in the OLED depending on a gate voltage. A high potential pixel power voltage VDD is applied to a drain of the second TFT T2. A source of the second TFT T2 is connected to an anode of the OLED via a second node B. The third TFT T3 connects the second node B to a third node C in responses to the second scan pulse Scan B. The third node C is connected to the reference line 16. The third TFT T3 maintains a turn-off state during a data enable period AA (refer to FIG. 6), in which data is applied to the pixels P, and is turned on in responses to the second scan pulse Scan B during a vertical blank period VB' (refer to FIG. 6), in which driving characteristics of the sub-pixels of each color in the pixels P are sensed. A drain of the third TFT T3 is connected to the second node B, and a source of the third TFT T3 is connected to the third node C. A gate of the third TFT T3 is connected to the second scan line 15, to which the second scan pulse Scan B is applied. The storage capacitor Cst is connected between the gate and the source of the second TFT T2 through the first and second nodes A and B. The anode of the OLED is connected to a source of a driving element DRTFT, and a cathode of the OLED is connected to a ground level voltage source GND.

Referring to FIG. 2, the display panel driving circuit includes a data driving circuit 12, a scan driving circuit 13, and a timing controller 11. The display panel driving circuit applies the data of the input image to the pixel array of the display panel 10.

The data driving circuit 12 includes at least one source drive integrated circuit (IC). The data driving circuit 12 converts pixel data DATA' of the input image received from the timing controller 11 into an analog gamma compensation voltage using a digital-to-analog converter (DAC) and generates the data voltage. The data driving circuit 12 outputs the data voltage to the data lines 14. Each pixel data DATA' includes red data, green data, blue data, and white data.

The data driving circuit 12 transmits a change value of the driving characteristic received through an analog-to-digital converter (ADC) and the reference line 16 to the timing controller 11. The DAC, the ADC, and a switch S1 shown in FIG. 4 are embedded in the data driving circuit 12.

The scan driving circuit 13 supplies a scan pulse (or a gate pulse) synchronized with an output voltage of the data driving circuit 12 to the scan lines 15 under the control of the timing controller 11 during the data enable period AA. The scan driving circuit 13 supplies the scan pulse for sensing changes in the driving characteristic to the scan lines 15 during the vertical blank period VB'. Thus, the scan driving circuit 13 sequentially shifts the scan pulse and sequentially selects the pixels, to which data is applied, on a per line basis. Further, the scan driving circuit 13 sequentially selects the pixels, of which the changes in the driving characteristic will be sensed, on a per line basis.

In general, time required to sense the changes in the driving characteristic of the pixel once is longer than one horizontal period. On the contrary, time assigned to charge the pixel with the new data voltage is one horizontal period. Thus, a width of the scan pulse generated in the vertical blank period VB' is set to be greater than a width of the scan pulse generated in the data enable period AA.

The timing controller 11 receives pixel data DATA of the input image and input timing signals from a host system (not shown). The input timing signals include a vertical sync signal Vsync, a horizontal sync signal Hsync, a data enable signal DE, a main clock MCLK, and the like. The timing controller 11 generates timing control signals DDC and GDC for respectively controlling operation timings of the data driving circuit 12 and the scan driving circuit 13 based on the input timing signals Vsync, Hsync, DE, and DCLK.

The timing controller 11 shortens the data enable period AA defined by the input timing signals and extends a vertical blank period VB, thereby increasing time capable of sensing the changes in the driving characteristics of the pixels in each frame. The timing controller 11 shortens the data enable period AA by increasing a frequency of the data enable period AA using a frame memory and a line memory and relatively extends the vertical blank period VB capable of sensing changes in driving characteristics of the sub-pixels of each color. The timing controller 11 generates signals shown in FIG. 5 during the extended vertical blank period VB' and makes the data driving circuit 12 sense changes in driving characteristics of sub-pixels of two or more colors in each frame.

The timing controller 11 executes an image quality compensation algorithm for calculating a compensation value based on a change value of the driving characteristic received from the data driving circuit 12. The image quality compensation algorithm may use any known algorithm compensating for the changes in the driving characteristics of the OLED display. The image quality compensation algorithm modulates the pixel data DATA of the input image using the compensation value. The compensation value includes an offset value, which is added to and subtracted from the pixel data DATA and compensates for the threshold voltage of the driving TFT, and a gain value which is multiplied by the pixel data DATA and compensates for the mobility of the driving TFT. The timing controller 11 transmits the pixel data DATA' modified by the image quality compensation algorithm to the data driving circuit 12.

The host system may be implemented as one of a television system, a set-top box, a navigation system, a DVD player, a Blu-ray player, a personal computer (PC), a home theater system, and a phone system.

The embodiment of the invention applies an external compensation method for compensating for the changes in the driving characteristics of the sub-pixels of each color of the pixels using the timing controller 11 and the data driving circuit 12, thereby increasing the yield and the lifespan of the OLED display. Further, the embodiment of the invention may omit or minimize an internal compensation circuit in the pixel using the external compensation method and implements the pixel as the simple configuration shown in FIG. 4, thereby increasing an aperture ratio and the yield of the pixel.

Figure 5:
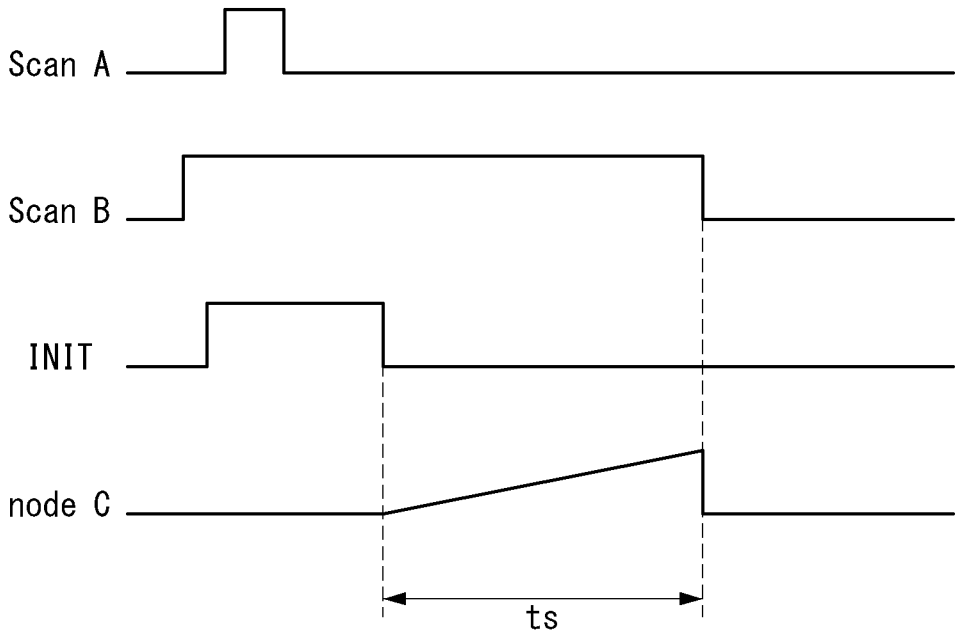
FIG. 5 is a waveform diagram showing signals for sensing changes in driving characteristic.

FIG. 4 is an equivalent circuit diagram of the pixel. FIG. 5 is a waveform diagram showing signals for sensing changes in driving characteristic.

As shown in FIGS. 4 and 5, the timing controller 11 generates the first and second scan pulses Scan A and Scan B and an initialization pulse NIT during the vertical blank period VB'. A width of the first scan pulse Scan A is less than a width of the second scan pulse Scan B. A width of the initialization pulse INIT is greater than the width of the first scan pulse Scan A and is less than the width of the second scan pulse Scan B. After the second scan pulse Scan B rises, the initialization pulse INIT and the first scan pulse Scan A sequentially rise. Subsequently, after the first scan pulse Scan A falls, the initialization pulse INIT and the second scan pulse Scan B sequentially fall.

The data driving circuit 12 supplies a predetermined data voltage, which is previously determined to sense the changes in the driving characteristic during the vertical blank period VB', to the data lines 14. The data voltage is set to a predetermined voltage irrespective of the data voltage of the input image.

The third TFT T3 is turned on in response to the second scan pulse Scan B and connects the second and third nodes B and C. Subsequently, the initialization pulse INIT turns on the switch S1 and supplies a predetermined initialization voltage Vinit to the third node C. The initialization voltage Vinit initializes the second and third nodes B and C. Subsequently, the first scan pulse Scan A is generated, and the predetermined data voltage is applied to the gate of the second TFT T2. Hence, voltages of the second and third nodes B and C rise. The ADC converts the voltage change of the third node C rising for a sensing time is into a digital value and generates a change value of the driving characteristic. The change value of the driving characteristic is transmitted to the timing controller 11.

Figure 6:
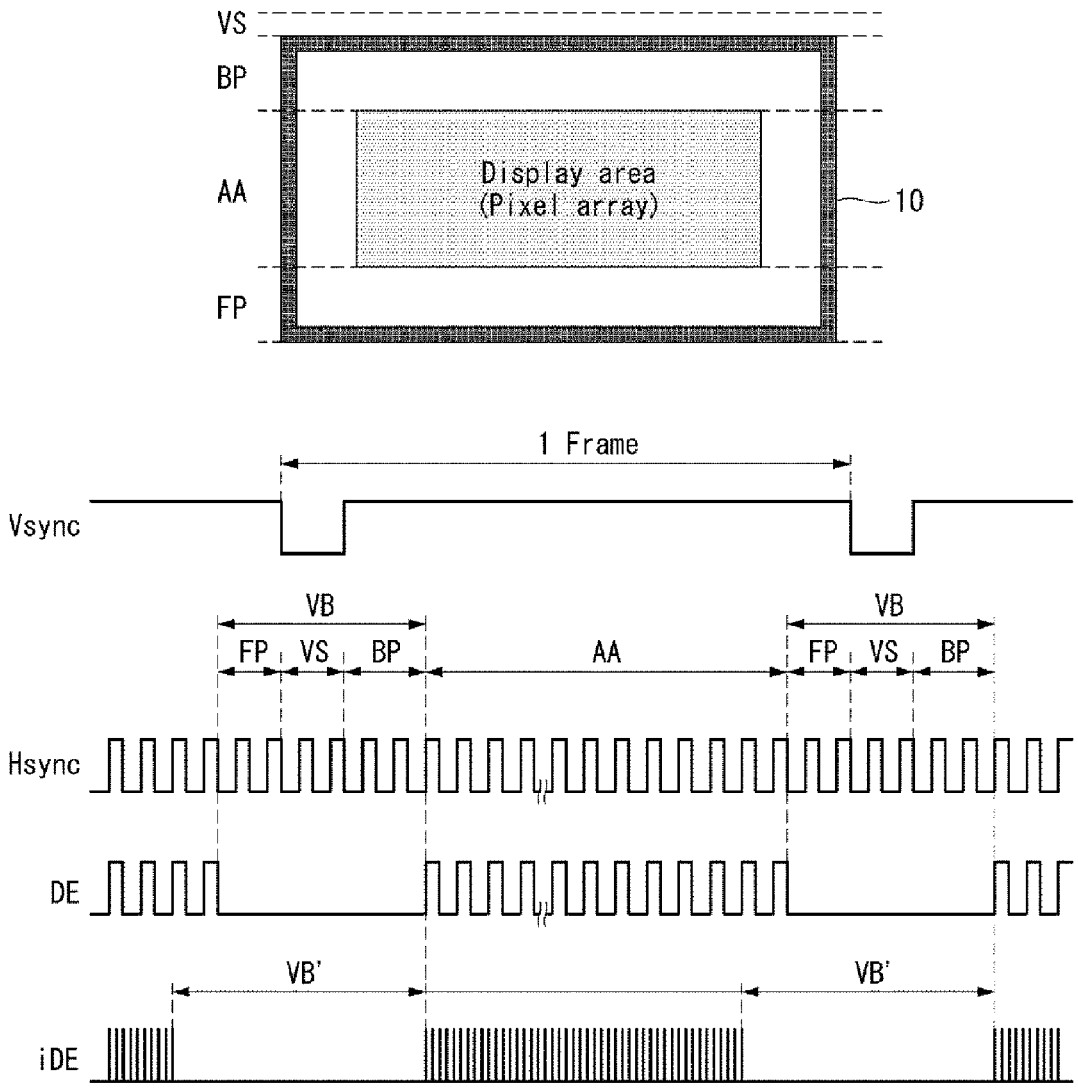
FIG. 6 is a waveform diagram showing display timing based on a video electronics standards association (VESA)

FIG. 6 is a waveform diagram showing display timing based on a video electronics standards association (VESA).

As shown in FIG. 6, one frame period defined by the input timing signals is divided into the data enable period AA and the vertical blank period VB.

The data enable signal DE is synchronized with data of the input image. A cycle of one pulse of the data enable signal DE is one horizontal period, and a high logic period (i.e., a pulse width) of the data enable signal DE indicates data timing of one line. One horizontal period is a horizontal address time required to apply data to the pixels on one line of the display panel 10.

The data enable signal DE and data of the input image are input during the data enable period AA and are not input during the vertical blank period VB. The data enable period AA is a vertical address time required to display the pixel data corresponding to one frame on all of the pixels of the pixel array.

The vertical blank period VB includes a vertical sync time VS, a vertical front porch FP, and a vertical back porch BP.

The vertical sync time VS is a time ranging from a falling edge to a rising edge of the vertical sync signal Vsync and indicates a start (or an end) timing of one screen. The vertical front porch FP is a time ranging from a falling edge of a last pulse of the data enable signal DE indicating data timing of a last line of one frame data to a state time point of the vertical blank period VB. The vertical back porch BP is a time ranging from an end time point of the vertical blank period VB to a rising edge of a first pulse of the data enable signal DE indicating data timing of a first line of one frame data.

In FIG. 6, VB' indicates the vertical blank period extended by the timing controller 11, and "iDE" indicates an internal data enable signal generated by the timing controller 11.

Figure 7:
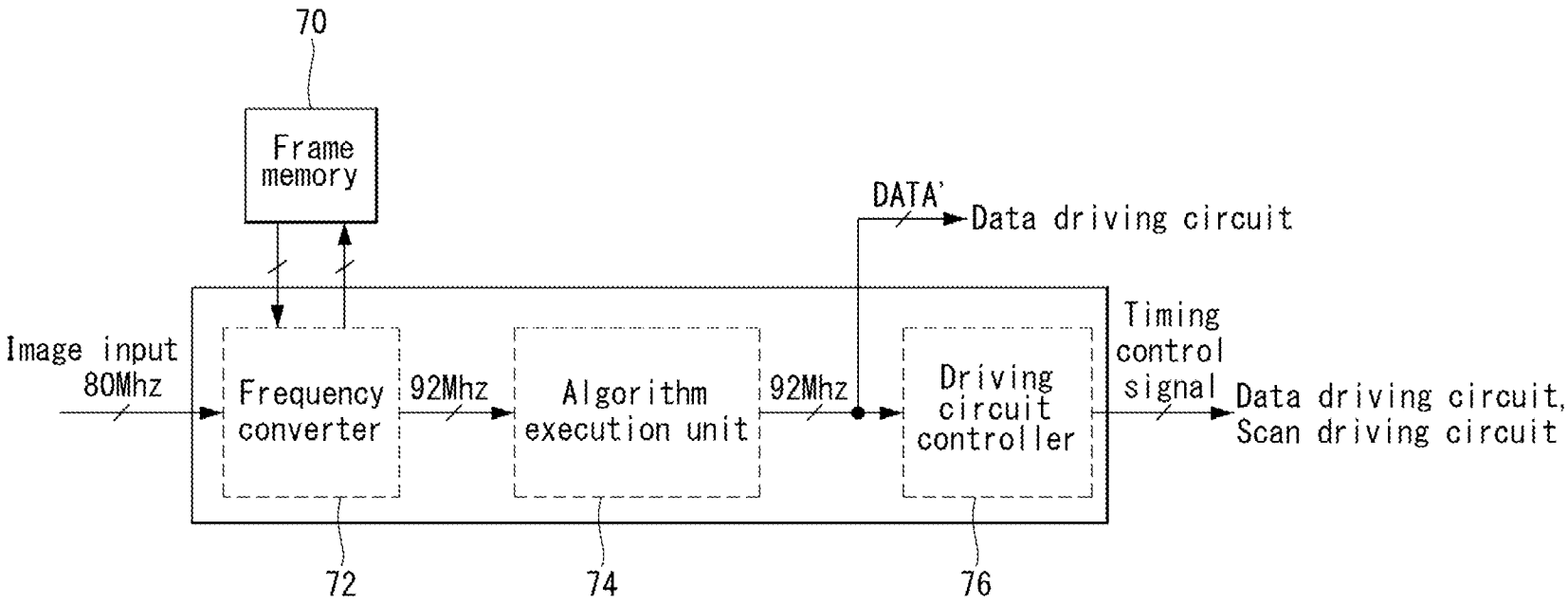
FIGS. 7 and 8 are block diagrams showing in detail a timing controller shown in FIG. 2.
Figure 8:
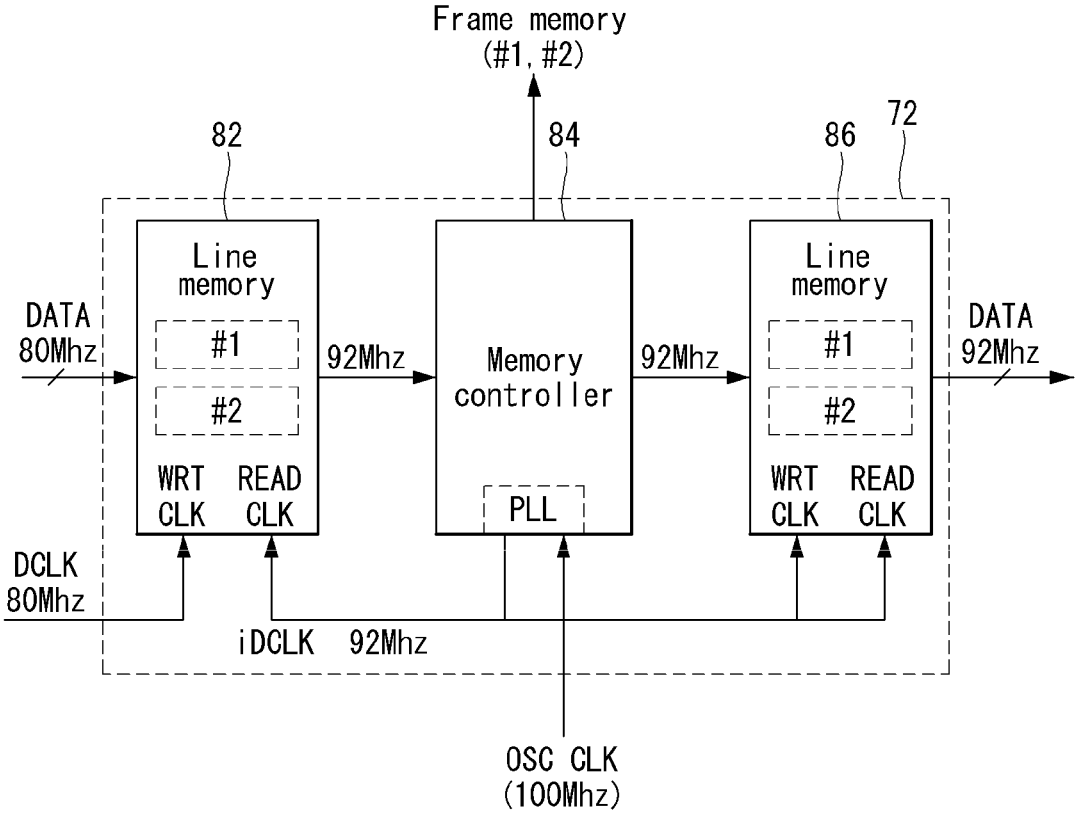

FIGS. 7 and 8 are block diagrams showing in detail the timing controller 11.

As shown in FIGS. 7 and 8, the timing controller 11 includes a frame memory 70, a frequency converter 72, an algorithm execution unit 74, a driving circuit controller 76, and the like.

The frame memory 70 reads or writes the pixel data of the input image on an internal storage space by the frequency converter 72. The frame memory 70 may include two frame memories 70#1 and 70#2, so as to shorten a delay time in data read and write processes. The frame memory 70 may be implemented as double data rate synchronous dynamic random access memory (DDR SDRAM).

The frequency converter 72 increases a data frequency of the input image using at least two input line memories #1 and #2, in which a read frequency is higher than a write frequency, and shorten the data enable period AA.

As shown in FIG. 8, the frequency converter 72 includes input line memories 82, a memory controller 84, and output line memories 86.

The input line memories 82 include first and second line memories 82#1 and 82#2, in which a read frequency is higher than a write frequency. The output line memories 86 include first and second line memories 86#1 and 86#2, in which a read frequency is equal to a write frequency.

The input line memories 82#1 and 82#2 are used to shorten the data enable signal. The frame memory 70 stores data corresponding to one frame, which is input through the input line memories 82, at a high write speed and shorten the data enable period AA. The frame memory 70 shorten the data enable period AA and relatively extends the vertical blank period VB in one frame period.

The output line memories 86#1 and 86#2 are used to prevent the problem of the delay time generated when reading the pixel data from the frame memory 70. If there is no problem of the delay time when the pixel data is read from the frame memory 70, the output line memories 86 may be omitted.

An input dot clock DCLK of a first frequency is applied to write clock terminals WRT CLK of the input line memories 82. An internal dot clock iDCLK of a second frequency higher than the first frequency is applied to read clock terminals READ CLK of the input line memories 82. The internal dot clock iDCLK of the second frequency is applied to write clock terminals WRT CLK and read clock terminals READ CLK of the output line memories 86.

Hereinafter, the embodiment of the invention is described on the assumption that the first frequency is 80 MHz, the second frequency is 90 MHz, and a write frequency of the frame memory 70 is 736 MHz, as an example. However, the embodiment of the invention is not limited thereto.

The input dot clock DCLK of the first frequency is applied to the write clock terminals WRT CLK of the input line memories 82. The internal dot clock iDCLK of the second frequency higher than the first frequency is applied to the read clock terminals READ CLK of the input line memories 82.

The memory controller 84 controls the read frequency of the input line memories 82 to be higher than the write frequency of the input line memories 82. Further, the memory controller 84 controls read and write operation timings of each of the input line memories 82 and the frame memories 70. For this, the memory controller 84 generates the internal dot clock iDCLK having a frequency higher than a frequency of the input dot clock DCLK and also generates an internal data enable signal iDE having a frequency higher than a frequency of the data enable signal DE. The memory controller 84 generates the internal dot clock iDCLK of a high frequency using a clock generator, for example, a phase-locked loop (PLL). The clock generator divides a high speed clock OSC CLK input from an internal oscillator OSC by a predetermined division ratio and generates the internal dot clock iDCLK having a stable frequency and a locked phase.

The algorithm execution unit 74 executes a previously determined image quality compensation algorithm and calculates a compensation value for compensating for a change amount of the driving characteristic of the pixel input through the ADC of the data driving circuit 12. The compensation value includes at least one of an offset value for compensating for a change amount ΔVth of a threshold voltage of the second TFT T2 and a gain value for compensating for a change amount Δμ of a mobility of the second TFT T2. For example, the algorithm execution unit 74 may compensate for changes in the mobility of the second TFT T2 during the vertical blank period VB, or may compensate for both changes in the threshold voltage and changes in the mobility of the second TFT T2 during the vertical blank period VB.

The driving circuit controller 76 generates the timing control signals DDC and GDC for respectively controlling operation timings of the data driving circuit 12 and the scan driving circuit 13 based on the internal dot clock iDCLK and the internal data enable signal iDE, each of which is generated at a frequency higher than an input frequency.

Figure 9:
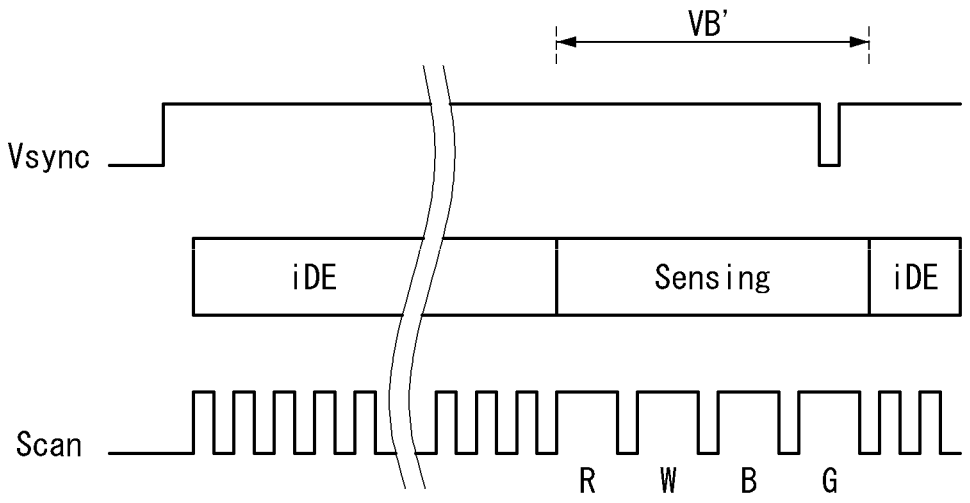
FIG. 9 shows an extension of a sensing time of changes in driving characteristic.
Figure 10:
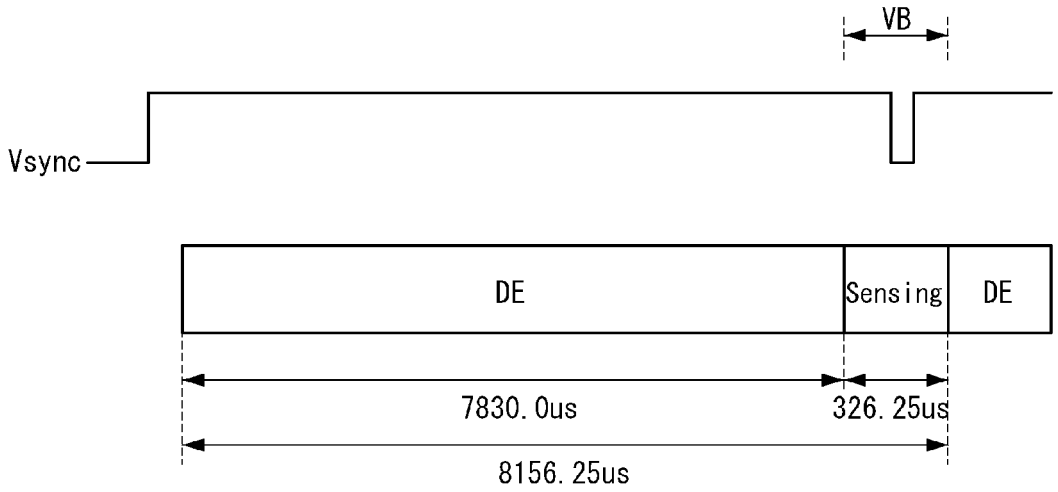
FIG. 10 shows an improvement effect of sensing time according to an exemplary embodiment of the invention as compared to a related art.
Figure 10:
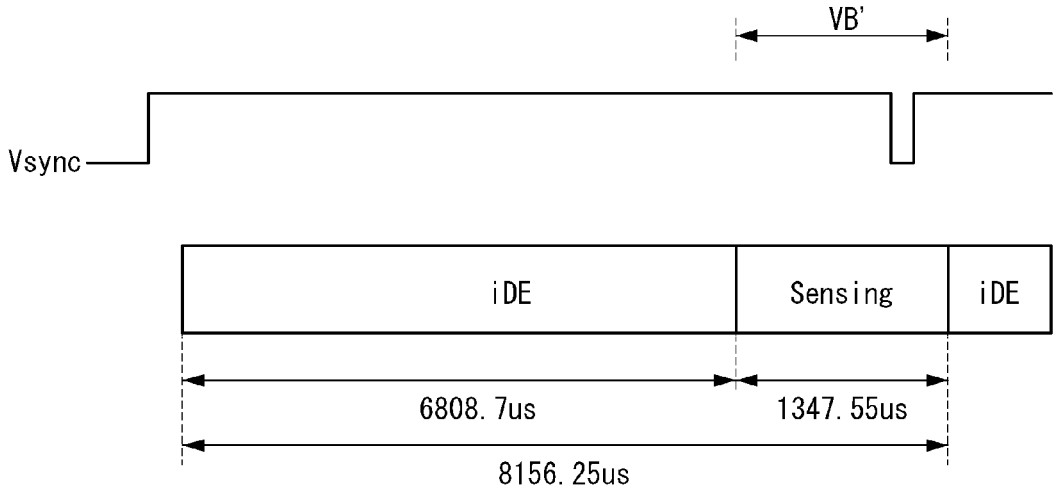

FIG. 9 shows an extension of a sensing time of changes in driving characteristic. FIG. 10 shows an improvement effect of sensing time according to the embodiment of the invention as compared to a related art. In FIG. 10, (A) indicates an example of the related art, and (B) indicates the embodiment of the invention.

As shown in FIGS. 9 and 10, the embodiment of the invention may shorten the data enable period AA in one frame period of the OLED display and may extend the sensing time assigned within the vertical blank period VB. As a result, the embodiment of the invention may sense changes in driving characteristics of sub-pixels of n colors included in one line within one vertical blank period VB, where n is a positive integer equal to or greater than 2. Further, the embodiment of the invention may rapidly update compensation values for compensating for changes in the driving characteristic of each sub-pixel of all of the pixels and may shorten a compensation cycle of the driving characteristic.

When a frequency of the dot clock increases from 80 MHz to 92 MHz, a time of one horizontal period 1H is reduced from 3.625 μs to 3.15 μs and is reduced from 7830 μs to 6808.7 μs based on the number of lines (i.e., 2160 lines) at a UD resolution. 290 dot clocks are input to one pulse cycle of the data enable signal. When the frequency of the dot clock is 80 MHz based on one frame period, the vertical blank period VB is about 326.25 μs corresponding to 90 horizontal periods. However, when the frequency of the dot clock increases to 92 MHz based on one frame period, the vertical blank period VB is about 1347.55 μs and increases to about four times. As a result, the embodiment of the invention may sense changes in the driving characteristic of each of the sub-pixels of four colors in each frame period.

When a resolution of the display panel driven at a frame rate of 120 Hz is UD (3840*2160) and one pixel includes four sub-pixels R, G, B, and W, the related art could sense changes in driving characteristic of the sub-pixels of one color during one vertical blank period VB. Thus, in the related art, time required to sense changes in driving characteristics of the sub-pixels of four colors on all of the lines of the display panel was 4 (sub-pixel)*2160 (line)/120 (Hz)=72 (sec). On the other hand, because the embodiment of the invention can sense changes in the driving characteristics of the sub-pixels of four colors during one vertical blank period VB, time required to sense changes in driving characteristics of the sub-pixels of four colors on all of the lines of the display panel is reduced to 4 (sub-pixel)*2160 (line)/120 (Hz)/4 (times)=18 (sec). Hence, the embodiment of the invention may reduce compensation update time.

Figure 11:
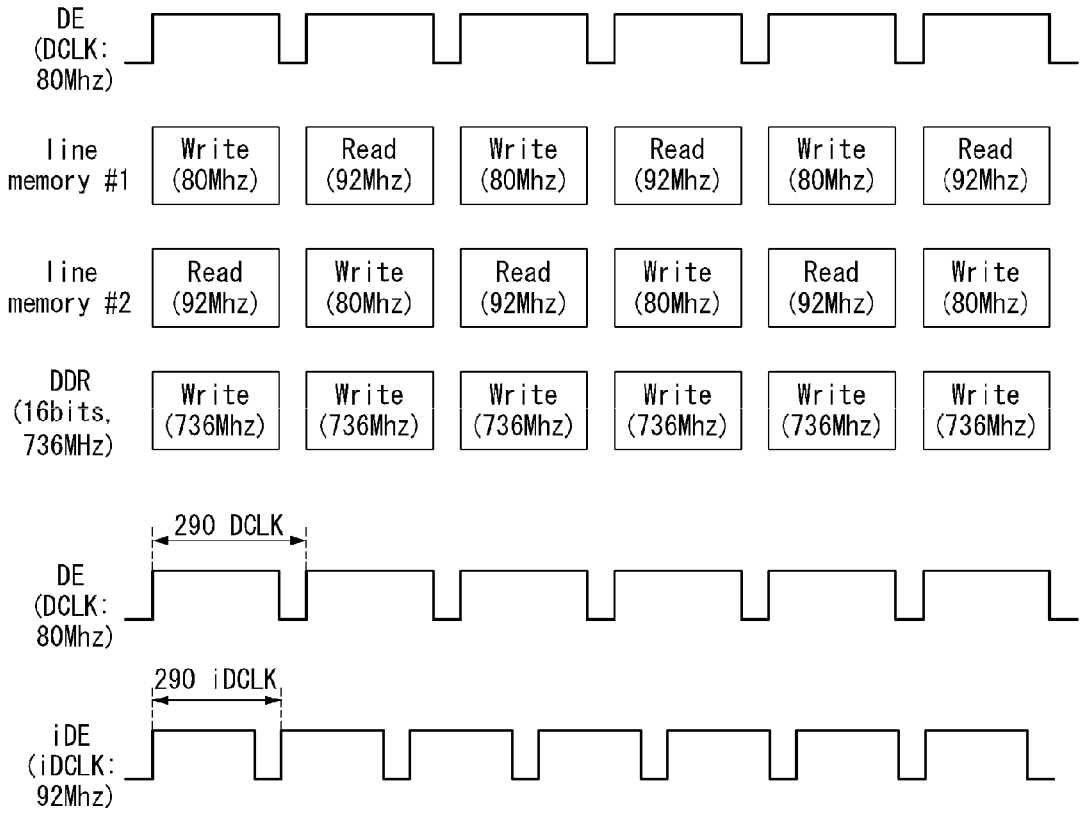
FIG. 11 is a waveform diagram showing an example of a frequency conversion operation of a timing controller.

FIG. 11 is a waveform diagram showing an example of a frequency conversion operation of the timing controller. More specifically, FIG. 11 shows read and write operations of the input line memories 82#1 and 82#2 and the frame memory.

As shown in FIG. 11, the input line memories 82#1 and 82#2 alternately read or write the pixel data DATA of the input image under the control of the memory controller 84. When the input dot clock DCLK is 80 MHz, the input line memories 82#1 and 82#2 write the pixel data DATA as 80 MHz and read the pixel data DATA as 92 MHz. The frame memory 70 reads and writes the pixel data DATA, which is alternately input from the input line memories 82#1 and 82#2 at a frequency of 736 MHz corresponding to eight times 92 MHz, under the control of the memory controller 84.

The input line memories 82 are used to increase a frequency of the data enable signal. When pixel data of Nth (where N is a positive integer) line is denoted by Nth Line, a read operation of the first input line memory 82#1 is denoted by Lime mem_in #1 Read, a write operation of the first input line memory 82#1 is denoted by Lime mem_in #1 Write, a read operation of the second input line memory 82#2 is denoted by Lime mem_in #2 Read, and a write operation of the second input line memory 82#2 is denoted by Lime mem_in #2 Write, operations of the input line memories 82 are as follows.

Nth Line: Line mem_in #1 Read(92 Mhz), Line mem_in #2 Write(80 Mhz)

(N+1)th line: Line mem_in #1 Write(80 Mhz), Line mem_in #2 Read(92 Mhz)

(N+2)th line: Line mem_in #1 Read(92 Mhz), Line mem_in #2 Write(80 Mhz)

(N+3)th line: Line mem_in #1 Write(80 Mhz), Line mem_in #2 Read(92 Mhz)

The pixel data from the first and second input line memories 82#1 and 82#2 is alternately input to the frame memory 70. The frame memory 70 may include two frame memories which alternately perform a read operation and a write operation of the pixel data. The memory controller 84 alternately writes the pixel data DATA read from the input line memories 82#1 and 82#2 on the two frame memories. For example, the pixel data DATA may be read from the first frame memory and may be written on the second frame memory during odd-numbered frame periods. Subsequently, the pixel data DATA may be read from the second frame memory and may be written on the first frame memory during even-numbered frame periods.

When an Nth frame period is denoted by Nth Frame, a read operation of the first frame memory 70#1 is denoted by DDR #1 Read, a write operation of the first frame memory 70#1 is denoted by DDR #1 Write, a read operation of the second frame memory 70#2 is denoted by DDR #1 Read, and a write operation of the second frame memory 70#2 is denoted by DDR #2 Write, an operation of the frame memory 70 are as follows.

Nth Frame: DDR #1 Write(736 Mhz), DDR #2 Read(736 Mhz)

(N+1)th Frame: DDR #1 Read(736 Mhz), DDR #2 Write (736 Mhz)

(N+2)th Frame: DDR #1 Write(736 Mhz), DDR #2 Read (736 Mhz)

(N+3)th Frame: DDR #1 Read(736 Mhz), DDR #2 Write (736 Mhz)

The output line memories 86 temporarily store the pixel data read from the frame memory 70. The output line memories 86 are used to continuously transmit the pixel data to the data driving circuit 12. The output line memories 86 perform the read operation and the write operation at the same frequency as the write frequency of the input line memories 82 as shown in FIG. 8. When the pixel data of the Nth line is denoted by Nth Line, a read operation of the first output line memory 86#1 is denoted by Lime mem_out #1 Read, a write operation of the first output line memory 86#1 is denoted by Lime mem_out #1 Write, a read operation of the second output line memory 86#2 is denoted by Lime mem_out #2 Read, and a write operation of the second output line memory 86#2 is denoted by Lime mem_out #2 Write, operations of the output line memories 86 are as follows.

Nth Line: Line mem_out #1 Read(92 Mhz), Line mem_out #2 Write(80 Mhz)

(N+1)th line: Line mem_out #1 Write(92 Mhz), Line mem_out #2 Read(92 Mhz)

(N+2)th line: Line mem_out #1 Read(92 Mhz), Line mem_out #2 Write(92 Mhz)

(N+3)th line: Line mem_out #1 Write(92 Mhz), Line mem_out #2 Read(92 Mhz)

As described above, the embodiment of the invention can extend the vertical blank period including the sensing time for sensing the driving characteristics of the pixels using the line memories and the frame memories. As a result, the embodiment of the invention can shorten the total sensing time required to sense changes in the driving characteristics of all of the pixels of the OLED display and thus can reduce the update cycle of the compensation value.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode display, in which one frame period is divided into a data enable period and a vertical blank period, comprising:

a data driving circuit configured to convert pixel data into a data voltage and supply the data voltage to data lines of a display panel during the data enable period, and to sense changes in driving characteristics of the display panel within an extended vertical blank period;

a scan driving circuit configured to supply a scan pulse synchronized with the data voltage to scan lines of the display panel during the data enable period, and to output a scan pulse for sensing the changes in the driving characteristics within the extended vertical blank period; and a timing controller configured to compensate for data of an input image using a compensation value determined based on the changes in the driving characteristics, transmit the compensated data to the data driving circuit, and control operation timing of the data driving circuit and operation timing of the scan driving circuit, wherein the timing controller shortens the data enable period defined by an input timing signal and extends the extended vertical blank period to be longer than the vertical blank period defined by the input timing signal, and wherein the scan driving circuit sequentially outputs n scan pulses to a same line of the display panel within the extended vertical blank period so that the data driving circuit sequentially senses changes in driving characteristics for sub-pixels of n colors included in the same line of the display panel within the extended vertical blank period of the one frame period, where n is a positive integer equal to or greater than 2 and equal to or less than 4.

2. The organic light emitting diode display of claim 1, wherein the timing controller includes:

a first and a second input line memories configured to alternately operate on a per line of the display panel basis and alternately read and write pixel data of one line;

a first and a second frame memories configured to alternately operate on a per frame period of the display panel basis and read and write data input from the first and the second input line memories; and a memory controller configured to control a read frequency of each of the first and second input line memories to be higher than a write frequency of each of the first and the second input line memories and control read and write operation timing of the first and the second input line memories and read and write operation timing of the first and second frame memories.

3. The organic light emitting diode display of claim 2, wherein the timing controller further includes first and second output line memories configured to alternately operate on a per line of the display panel basis and alternately read and write pixel data input from the first and second frame memories, wherein the memory controller controls a read frequency and a write frequency of each of the first and second output line memories at the same frequency as the write frequency of the first and second input line memories.

4. The organic light emitting diode display of claim 1, wherein a width of the n scan pulses generated within the extended vertical blank period is greater than a width of the scan pulse generated within the data enable period.

5. The organic light emitting diode display of claim 1, wherein the compensation value includes at least one of an offset value for compensating for changes in a threshold voltage of a driving thin film transistor (TFT) included in each pixel of the display panel and a gain value for compensating for changes in a mobility of the driving TFT.

* * * * *